US006666454B1

(12) United States Patent
Cole et al.

(10) Patent No.: US 6,666,454 B1
(45) Date of Patent: Dec. 23, 2003

(54) ANIMATED CLAMSHELL PUZZLES

(75) Inventors: Jeffrey Charles Cole, Arvada, CO (US); Kenneth H. Fleck, Littleton, CO (US)

(73) Assignee: Accord Publishing LTD, Denver, CO (US)

( * ) Notice: Subject to any disclaimer, the term of this patent is extended or adjusted under 35 U.S.C. 154(b) by 0 days.

(21) Appl. No.: 10/217,282

(22) Filed: Aug. 12, 2002

Related U.S. Application Data

(62) Division of application No. 09/493,588, filed on Jan. 28, 2000, now Pat. No. 6,431,543.
(60) Provisional application No. 60/117,841, filed on Jan. 29, 1999.

(51) Int. Cl.[7] ..... A63F 9/10
(52) U.S. Cl. ..... 273/157 R; 273/153 R
(58) Field of Search ..... 273/153 R, 157 R, 273/118 R, 156, 123 R, 113, 118 D; 206/315.1, 579; 446/73, 75

(56) References Cited

U.S. PATENT DOCUMENTS

| | | | | |
|---|---|---|---|---|
| 423,066 A | | 3/1890 | Massey | |
| 480,983 A | | 8/1892 | Wolf | |
| 1,028,921 A | | 6/1912 | Wagner | |
| 1,033,576 A | | 7/1912 | Garman | |
| 2,085,414 A | | 6/1937 | Cavanagh | |
| 2,489,240 A | | 11/1949 | Meyer | |
| 2,538,085 A | | 1/1951 | Cotton | |
| 3,650,532 A | | 3/1972 | Dederich et al. | |
| 3,731,933 A | * | 5/1973 | Grant | 273/113 |
| 3,918,180 A | | 11/1975 | Chamberlin | |
| 4,486,018 A | * | 12/1984 | Keller, Jr. | 273/157 R |
| 4,861,036 A | * | 8/1989 | Watanabe | 273/113 |
| 5,897,416 A | | 4/1999 | Barrows | |
| 5,915,729 A | | 6/1999 | Vap | |
| 5,941,570 A | | 8/1999 | Cole et al. | |
| 6,149,201 A | * | 11/2000 | Cole et al. | 281/51 |
| 6,227,369 B1 | * | 5/2001 | Glassman | 206/469 |
| 6,319,088 B1 | * | 11/2001 | Cole et al. | 446/343 |

* cited by examiner

*Primary Examiner*—Steven Wong
(74) *Attorney, Agent, or Firm*—Rick Martin; Patent Law Offices of Rick Martin, P.C.

(57) ABSTRACT

Animated puzzle toys are disclosed ranging from simple flat panels having floating eyeballs, to clamshell packaging puzzles for animated display, to eyeball puzzle boxes, to multi-size and multi-number eyeballs, to 3D puzzle pieces, to stackable 3D eyeball containers.

19 Claims, 14 Drawing Sheets

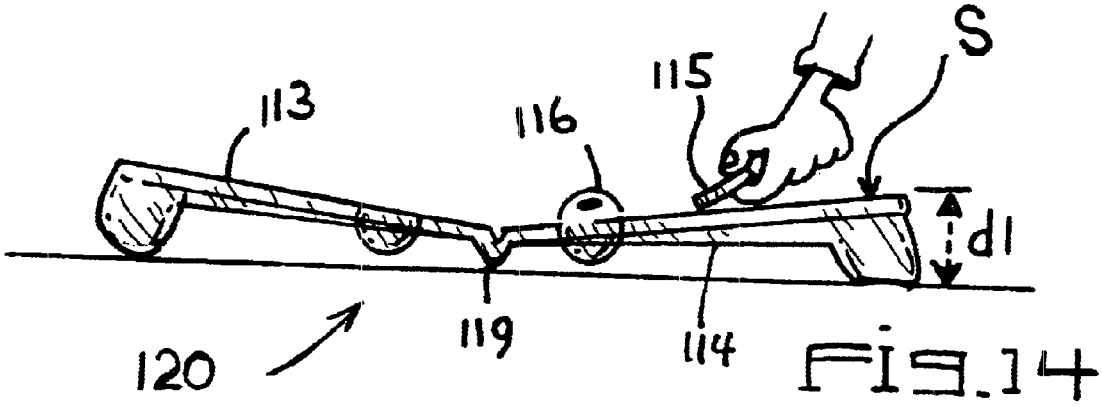
Fig.14
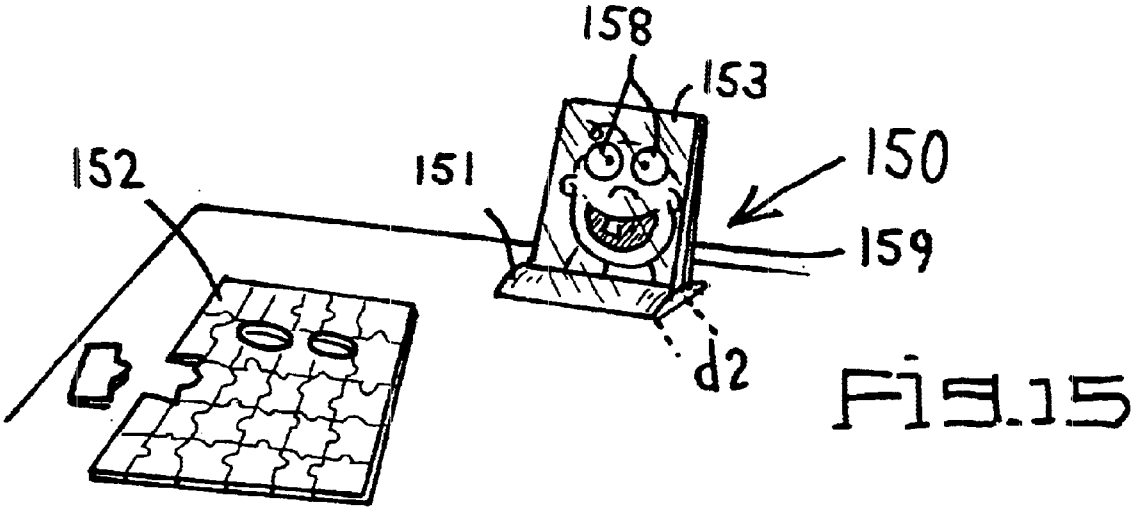
Fig.15
Fig.16
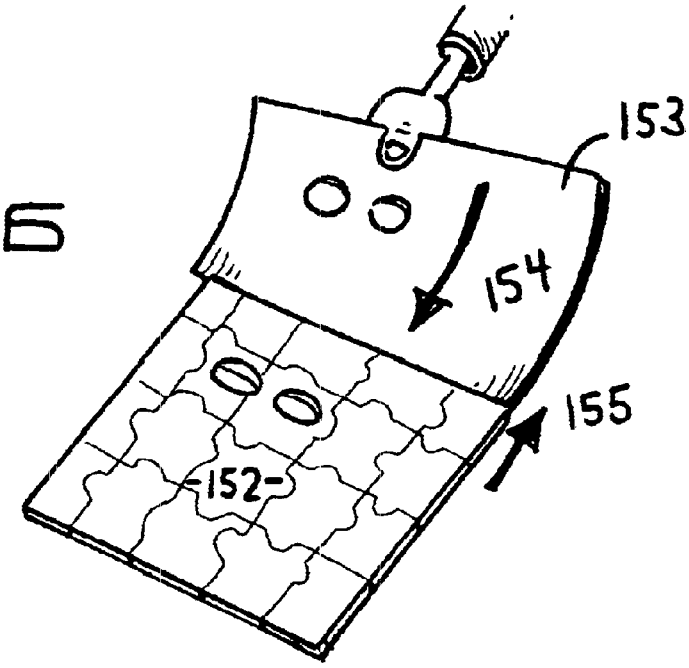

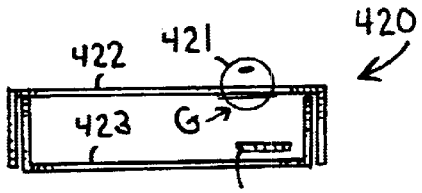
Fig. 42
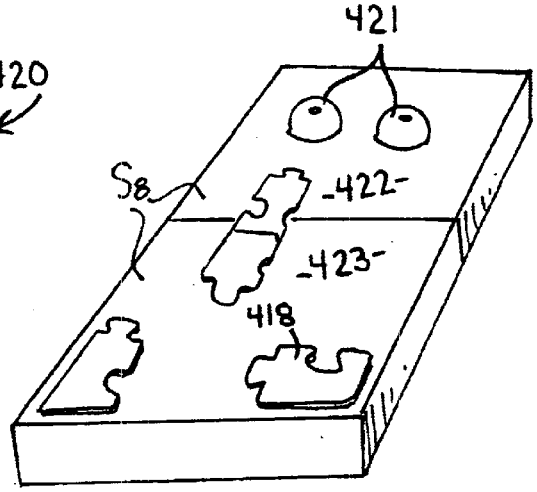
Fig. 43
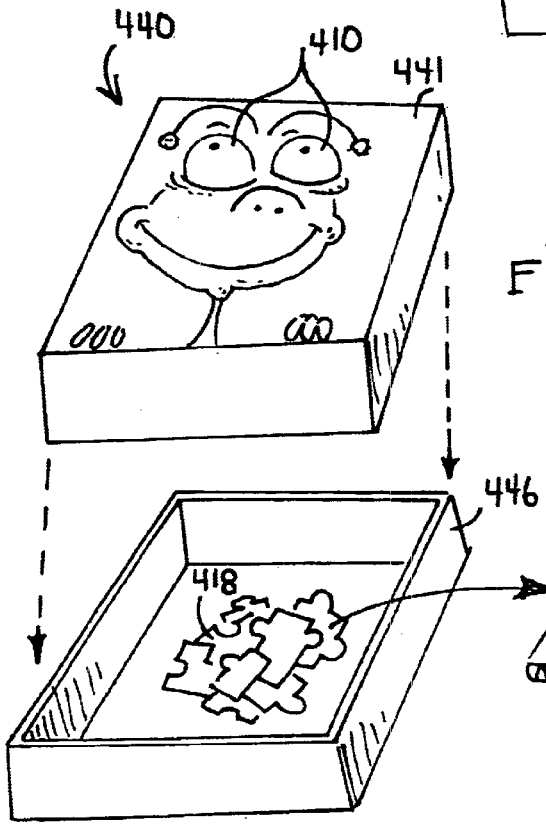
Fig. 44
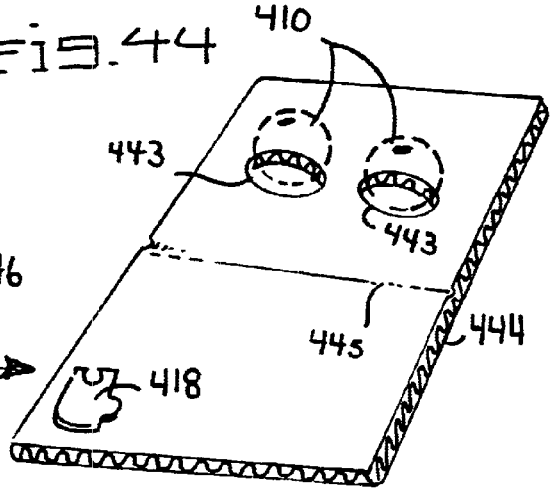

Fig.55
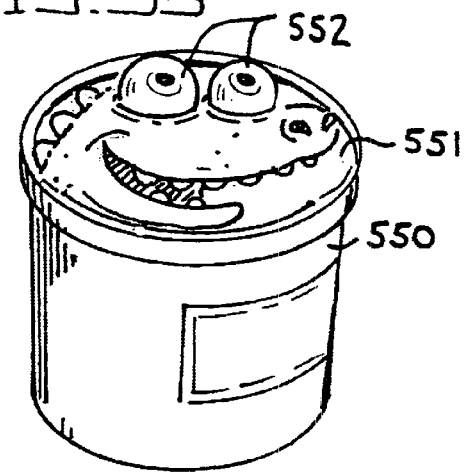
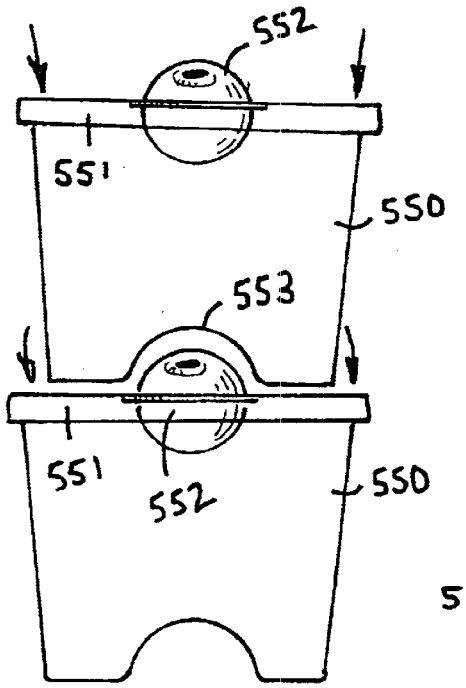
Fig.56
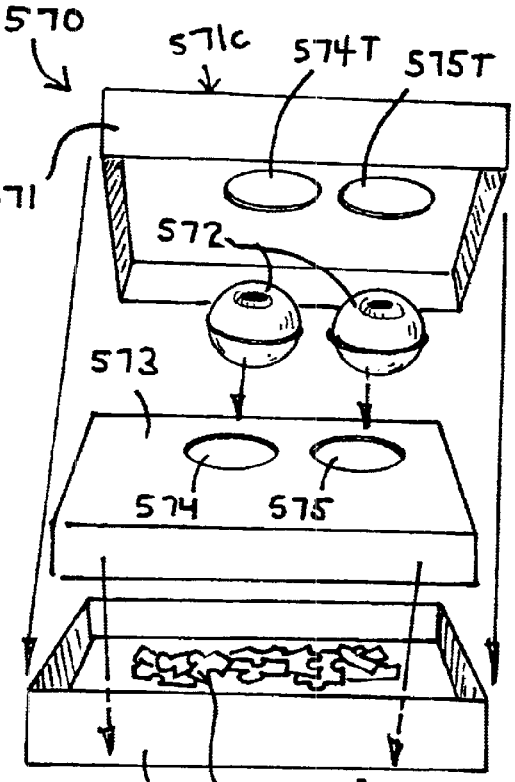
Fig.57
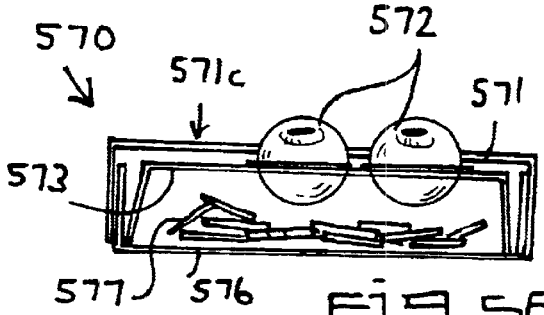
Fig.58

ANIMATED CLAMSHELL PUZZLES

CROSS-REFERENCE TO RELATED APPLICATION

This application is a divisional application of parent application Ser. No. 09/493,588 filed Jan. 28, 2000 which issued as U.S. Pat. No. 6,431,543 on Aug. 13, 2002. This application claims the benefit of Provisional Application No. 60/117,841, filed Jan. 29, 1999.

FIELD OF THE INVENTION

The present invention relates to using known spherical toy balls, commonly known as "floating eyeballs," Jet Balls™ or Glide Balls™ in a panel of a puzzle to create an amusing and entertaining three-dimensional display.

BACKGROUND OF INVENTION

Known in the art are "floating eyeballs" comprised of an eyeball-decorated (i.e. pupil, iris, blood vessels, etc.) inner sphere encased and floating within a larger clear outer sphere. The inner and outer spheres are separated by a clear liquid. The eyeball-decorated inner sphere is weighted such that the pupil automatically rotates no matter which direction the sphere is rotated. It is not known to combine the floating eyeball with a puzzle panel, thereby forming an animated puzzle. The present invention creates a toy that in one embodiment creates a plurality of facial expressions by combining said panels and one or more pair of floating eyeballs. It is known in the art that any floating objects including belly buttons, other body parts, insects, compass needles, other amusing objects, and/or graphic designs would all be equivalent to the best mode depiction herein of floating eyeballs.

SUMMARY OF THE INVENTION

The present invention is an animated toy puzzle used for amusement. The puzzle is comprised of a panel with one or more spherical toy balls, commonly known as the above noted "floating eyeballs." The puzzle can bear features resembling a human, insect, animal or other creature-like facial expression. The puzzle can bear facial features on both its front and back surfaces. The panel can be hingedly connected to a transparent cover to keep the pieces in the puzzle. The puzzle and floating eyeballs together make an entertaining three-dimensional character representation that can be controlled by the user to create an animated effect called "Eyeball Animation™." "Eyeball Animation™" describes a visual effect in which the eyeball-decorated inner sphere moves about the clear plastic outer sphere in a manner similar to human-like eye movement.

The primary aspect of the present invention is to affix a floating eyeball to a puzzle so as to create a variety of entertaining and amusing facial expressions and scenes via the combination.

Another aspect of the present invention is to allow the user to create additional entertaining and amusing scenes by shaking or tilting the puzzle causing the floating eyeballs to move in different directions thereby providing the artwork surrounding the "floating eyeballs" varied visual affects.

Another aspect of the present invention is to provide plastic packaging for retail exposure as well as storage for the puzzle pieces, both assembled and unassembled.

Another aspect of the present invention is to permit the user to create his own entertaining three dimensional representations by introducing a blank puzzle piece over and around the floating eyeballs affixed to the primary puzzle such that the user may draw, paint or otherwise place an image of his own creation on the blank puzzle piece(s).

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 14 is a side plan view of an opened clamshell puzzle having a large base.

FIG. 15 is a front perspective view of the FIG. 14 embodiment partially assembled.

FIG. 16 is a top perspective view of the puzzle of FIG. 15 completed and being moved into the open clamshell.

FIG. 42 is a side plan sectional view of a reversible bottom box member puzzle.

FIG. 43 is a top perspective view of the FIG. 42 embodiment assembled.

FIG. 44 is an exploded view of a palet-type puzzle and box.

FIG. 55 is a top perspective view of an eyeball container.

FIG. 56 is a side plan view of stackable eyeball containers.

FIG. 57 is an exploded view of a simple puzzle/box embodiment.

FIG. 58 is a cross sectional view of the embodiment of FIG. 57.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

The following pages provide many Eyeball Animation™ puzzle ideas and concepts. As it would be impractical to list every variation or possibility, only a limited number of possible concepts are documented herein. There are included, however, a range of options; from premium designs to the very simple, from expensive manufacturing costs to relatively inexpensive, from young age appeal to adult.

Figure 1:
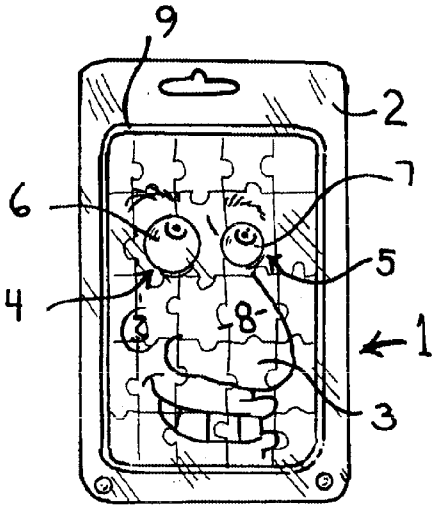
FIG. 1 is a top plan view of an animated puzzle.

Referring first to FIG. 1 a puzzle 1 is comprised of a panel 2 having puzzle pieces 3 which are graphically coordinated to make an image in this case of a man 8. Limitless possibilities exist for the choice of the puzzle's image. However, in the present preferred embodiment shown, the panel 2 has holes 4, 5 which support floating eyeballs 6, 7, the floating eyeballs being graphically coordinated with the puzzle's image. In this puzzle, floating eyeball 6 is larger than floating eyeball 7 which helps create a 3D profile look. The user can tilt and shake the panel 2 to create an animated toy puzzle 1. An optional ridge 9 may be used to secure the puzzle pieces. The puzzle pieces around the floating eyeballs form appropriate holes to enable the floating eyeballs 6, 7 to protrude therethrough.

Figure 2:
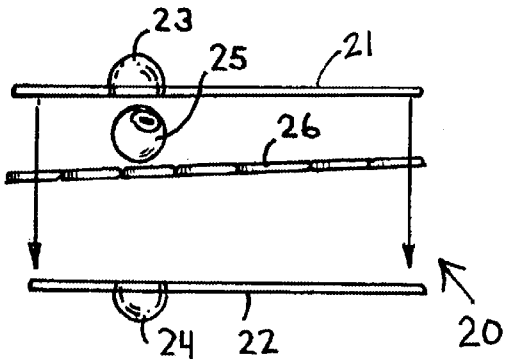
FIG. 2 is a side plan exploded view of a clamshell-type puzzle.

Referring next to FIG. 2 a clamshell puzzle 20 is shown. Upper clamshell half 21 has a cup 23 which houses the floating eyeball 25. When the lower clamshell half 22 is assembled against the upper clamshell half 21, the cup 24 locks the floating eyeball between cups 23, 24. The puzzle pieces 26 have holes aligned with the floating eyeball 25 so they lie flat between halves 21, 22.

Figure 4:
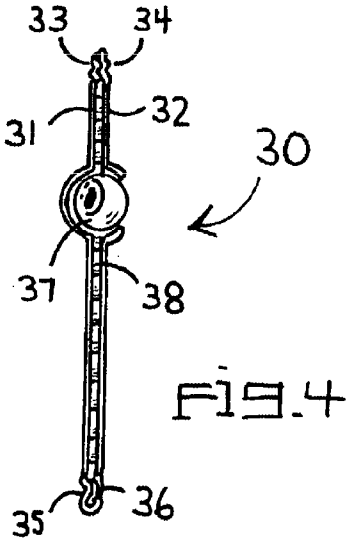
FIG. 4 is another side plan view of the FIG. 3 embodiment assembled.
Figure 3:
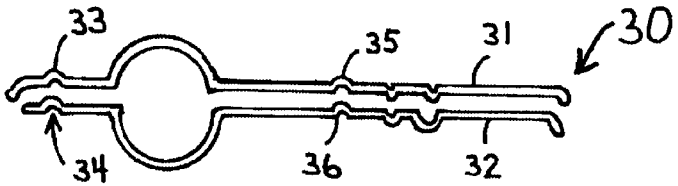
FIG. 3 is a side plan view of an alternate embodiment of a clamshell puzzle having rim locks.

Referring next to FIGS. 3, 4 a modified clamshell puzzle 30 has halves 31, 32. Rim locks 33, 34 and 35, 36 allow the halves 31, 32 to snap together and apart. In the art, the term "tab lock" is used. interchangeably with "rim lock". The floating eyeball 37 and puzzle pieces 38 are locked between halves 31, 32.

Figure 5:
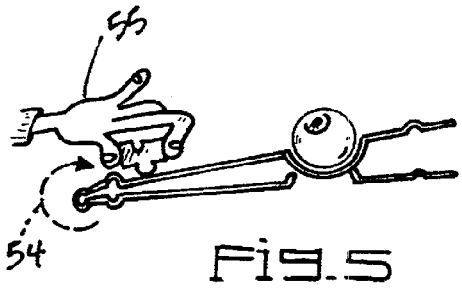
FIG. 5 is a side plan view of another clamshell embodiment having the upper and bottom halves hinged.
Figure 6:
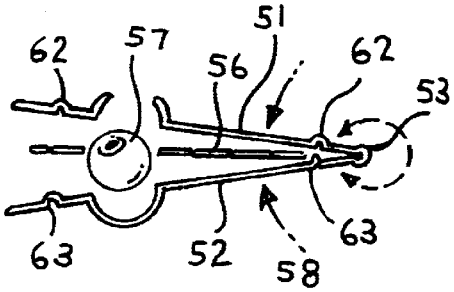
FIG. 6 is a side plan view of the FIG. 5 embodiment being closed.
Figure 7:
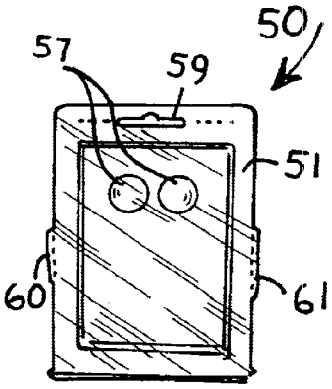
FIG. 7 is a top plan view of another clamshell having trimable heat-sealed sides.

Referring next to FIGS. 5, 6, 7 the clamshell halves 51 (upper), 52 (lower) of puzzle 50 form a hinge 53. The puzzle can be made from clear plastic vacuum formed or injection molded. The halves 51, 52 can reverse upon themselves as shown by arrows 54. In FIG. 5 the upper half 51 has rotated 360 degrees, locking onto the back of what was the lower half 52, thereby forming a platform for the puzzler 55. In FIG. 6 the pieces 56 are assembled and along with floating eyeball 57 are locked between halves 51, 52 when the halves are snapped together as indicated by arrows 58 using rim locks 62, 63. FIG. 7 shows the retail package 59 of the puzzle 50 which may include trimable heat seals 60, 61.

Figure 8:
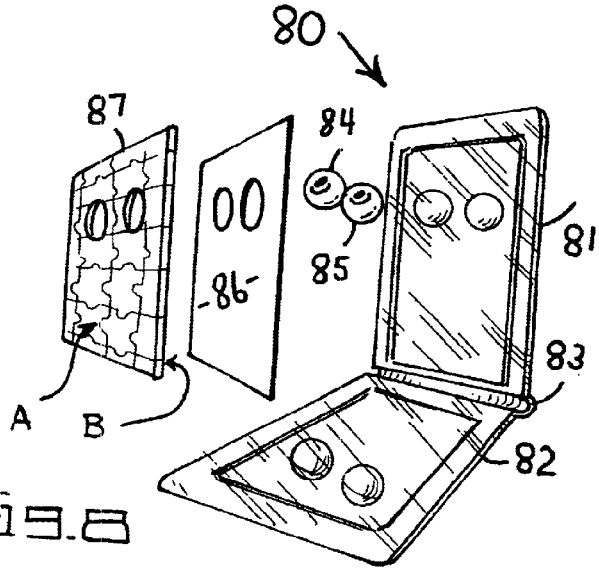
FIG. 8 is a side prospective view of a two-sided and/or poster embodiment puzzle.

Referring next to FIG. 8 a clamshell puzzle 80 has an upper half 81, a lower half 82, and a hinge 83. The floating eyeballs 84, 85 are supported between the halves 81, 82. The puzzle 87 may be one-sided only, side A or two-sided, sides A,B. If the puzzle 87 is one-sided, then a poster 86 (showing the completed puzzle or perhaps showing an advertisement can be inserted between halves 81, 82.

Figure 9:
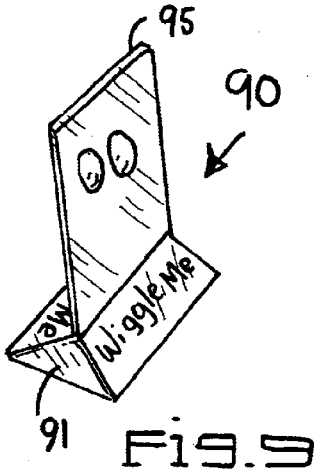
FIG. 9 is a top perspective view of a clamshell embodiment having a built-in stand.
Figure 10:
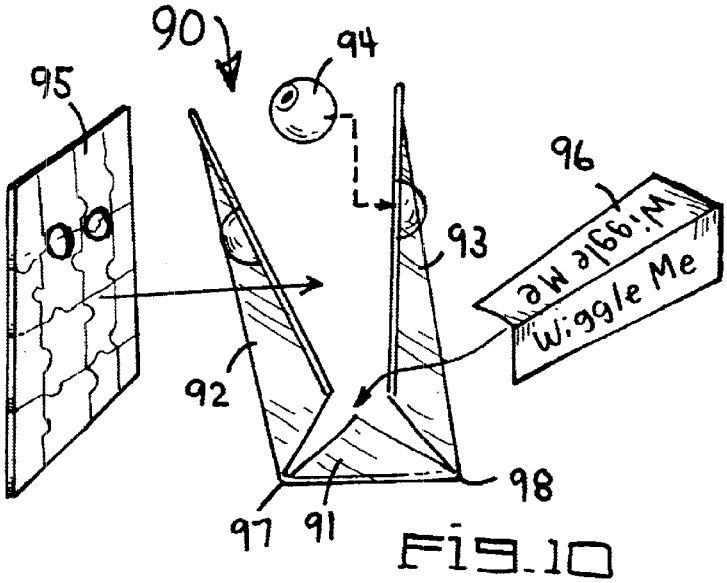
FIG. 10 is an exploded view of the FIG. 9 embodiment.
Figure 13:
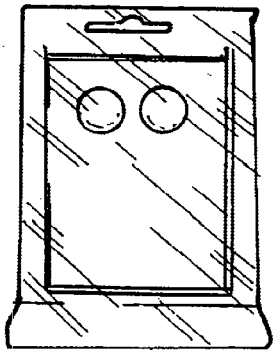
FIG. 13 is a front plan view of the FIG. 9 embodiment.

Referring next to FIGS. 9, 10 and 13 a standing clamshell puzzle 90 has an integral base 91 which supports halves 92, 93, floating eyeball 94, and puzzle 95. An advertising insert 96 can fit in the base 91 of the puzzle 90. Hinges 97, 98 at the bottom of halves 92, 93 form the base 91.

Figure 11:
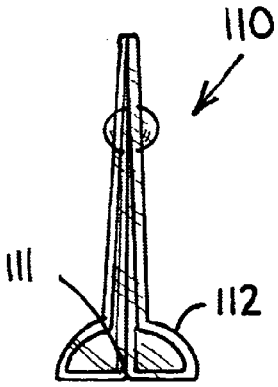
FIG. 11 is a side plan view of the FIG. 9 embodiment.

Referring next to FIG. 11 a standing clamshell puzzle 110 is hinged at the bottom at 111. The pedestal base 112 is designed as small as possible so that the pedestal 112 will not impede puzzle assembly when the puzzle 110 is laid on its side.

Figure 12:
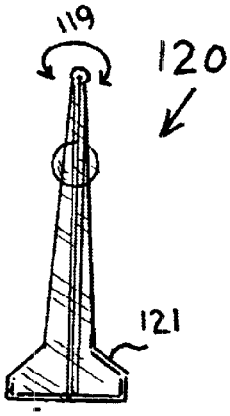
FIG. 12 is a side plan view of a clamshell like the FIG. 9 embodiment, but having a top hinge.

Referring next to FIGS. 12, 14 a standing clamshell puzzle 120 has an upper hinge 119, a base 121 and halves 113, 114. The halves 113, 114 sandwich the puzzle pieces 115 and floating eyeballs 116. The width $d_1$ of base 121 is relatively small so that the puzzler's working surface S lies relatively flat as shown in FIG. 14.

Referring next to FIGS. 15, 16 a standup clamshell is puzzle 150 has a base 151 having a relatively large width $d_2$. In this case, a puzzler may complete the puzzle 152 on a flat surface as shown in FIG. 15. The poster 153 is used as a tool to lift the puzzle off the surface as shown by arrows 154, 155. The puzzler slides the poster 153 under the finished puzzle and carefully transports the puzzle into the stand 159 when its in the open position. The floating eyeballs 158 are placed into their respective holes before closing the stand 159.

Figure 17:
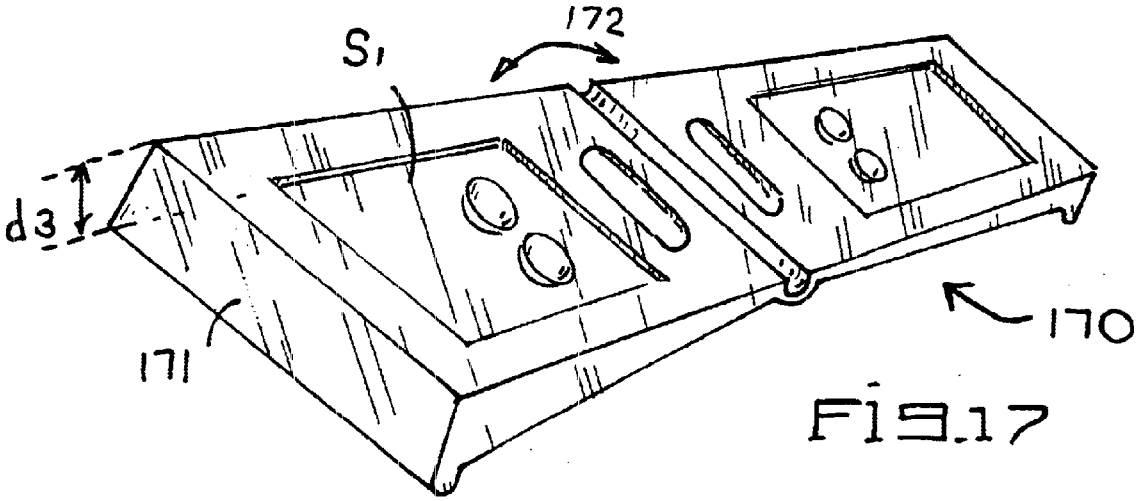
FIG. 17 is a top perspective view of a clamshell embodiment having a small base.

Referring next to FIG. 17 the standing clamshell puzzle 170 has a base 171 which has a relatively small width $d_3$, thereby allowing puzzler's work surface $S_1$ to lie relatively flat as shown. Arrows 172 indicates the open-to-play position of the puzzle 170.

Figure 18:
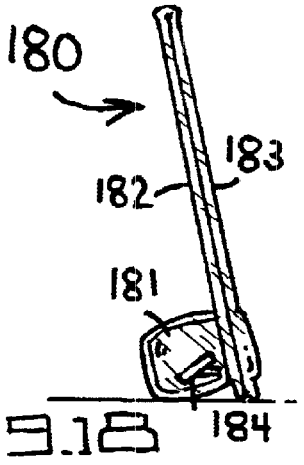
FIG. 18 is a side plan view of a clamshell embodiment having a storage compartment.
Figure 19:
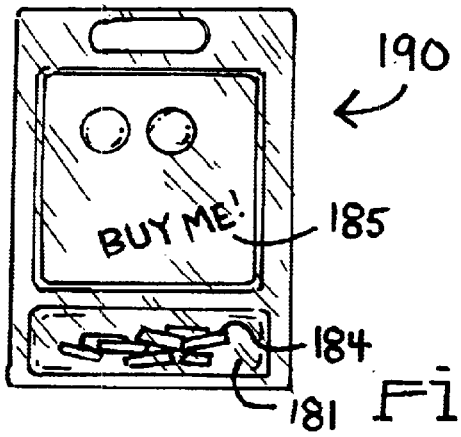
FIG. 19 is a front plan view of the FIG. 18 embodiment.

Referring next to FIG. 18 a puzzle 180 is shown to be of a clamshell design, fit as shown for retail display. A compartment 181 is formed by halves 182, 183. Puzzle pieces 184 are housed in the compartment 181. A poster 185 can include retail signage as shown.

Figure 20:
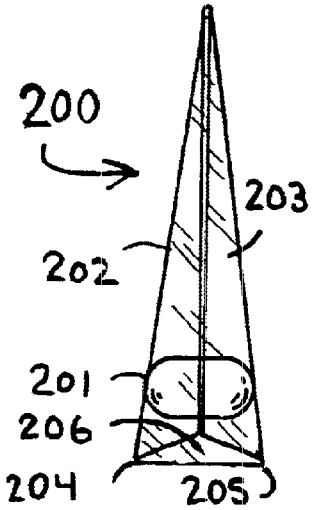
FIG. 20 is a side plan view of another version of a clamshell embodiment having a compartment.
Figure 21:
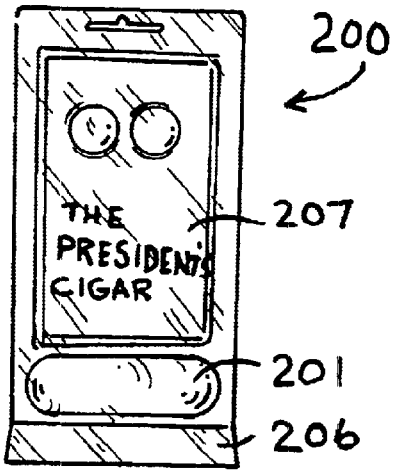
FIG. 21 is a front plan view of the FIG. 20 embodiment.

In FIG. 20 the compartment 201 of puzzle 200 is formed by halves 202, 203. Halves 202, 203 are hinged at 204, 205 to form a base 206. FIG. 21 shows how the puzzle 200 may contain a retail poster 207.

Figure 22:
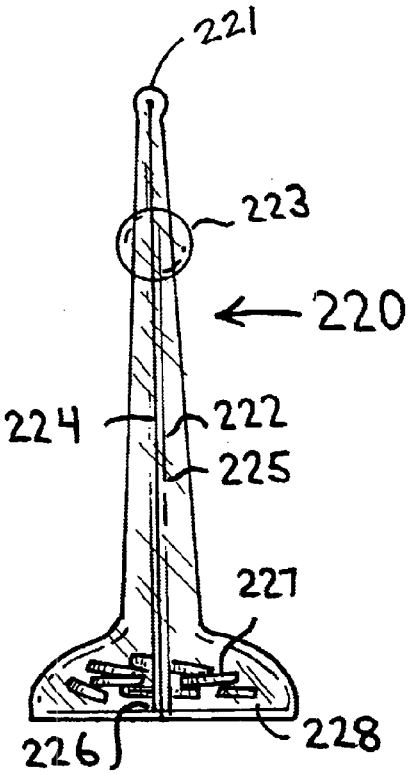
FIG. 22 is a side plan view of another version of a clamshell embodiment with the compartment in the base.

In FIG. 22 the hinge 221 of puzzle 220 is at the top of the clamshell package. There may be a poster 222 as well as the floating eyeballs 223 between the halves 224, 225. The puzzle pieces 227 are housed in the compartment 226, formed in the base 228.

Figure 23:
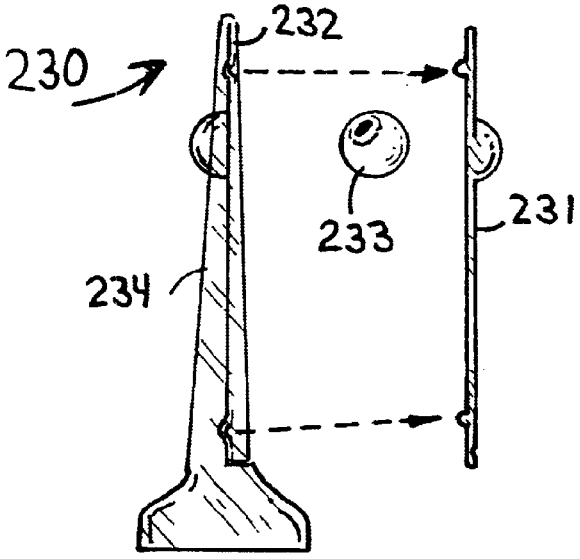
FIG. 23 is an exploded side view of a snap-off face clamshell embodiment.
Figure 24:
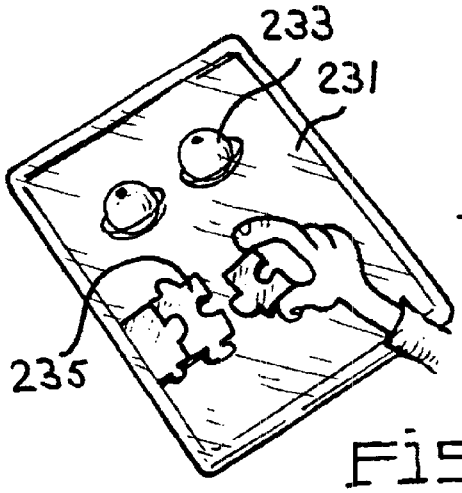
FIG. 24 is a top perspective view of the face of the FIG. 23 embodiment.
Figure 25:
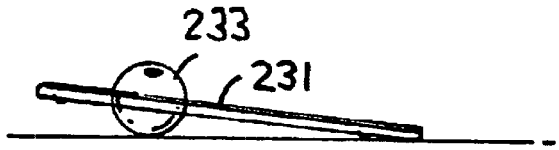
FIG. 25 is a side plan view of the FIG. 24 embodiment of the face.

Referring next to FIGS. 23, 24, 25 a "face-off design" of a standing clamshell puzzle 230 is shown. The face 231 snaps off half 232. The floating eyeball 233 is supported is between half 234 and face 231. The puzzle pieces 235 are assembled on the face 231 around the floating eyeballs 233.

FIG. 25 shows how the face 231 acts as a natural easel.

Figure 26:
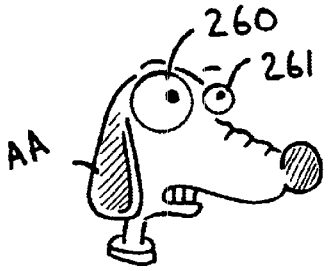
FIG. 26 is a front plan view of a puzzle having two different sized eyeballs.
Figure 27:
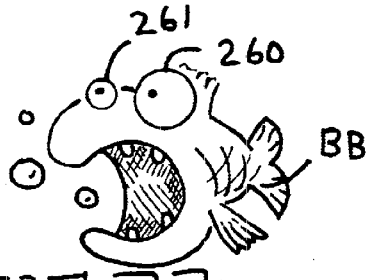
FIG. 27 is a back side view of the FIG. 26 puzzle.
Figure 28:
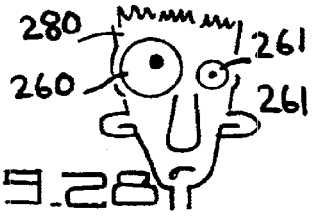
FIG. 28 is a front plan view of a worried or surprised character.
Figure 29:
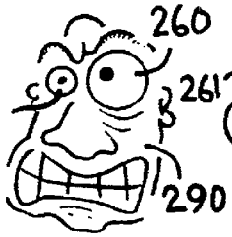
FIG. 29 is a front plan view of a suspicious or angry character.
Figure 30:
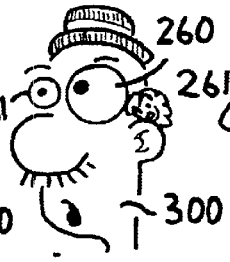
FIG. 30 is a front plan view of a three-fourth profile character.
Figure 31:
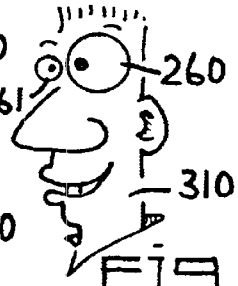
FIG. 31 is a front plan view of a side view character.
Figure 32:
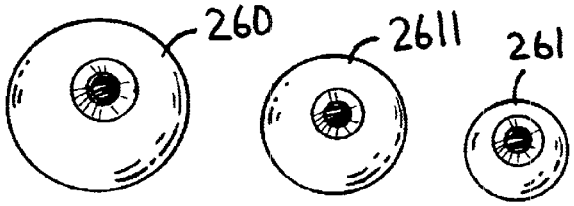
FIG. 32 is a front plan view of various sized floating eyeballs.
Figure 33:
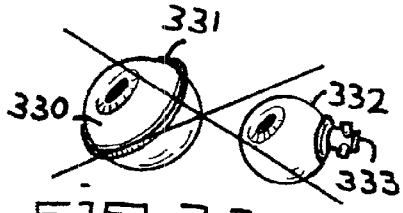
FIG. 33 is a side perspective view of floating eyeballs having special mounting features.

FIGS. 26–32 show how different-sized eyeballs can be used to create interesting and fun graphics. FIG. 26 shows the front side of a dog puzzle AA having one large eyeball 260 and one small eyeball 261. The rear side BB of the puzzle has a fish figure. FIG. 28 shows a worried/surprised man 280. FIG. 29 shows a suspicious/angry man 290. FIG. 30 shows a profile perspective look of man 300. FIG. 31 shows a side view profile with perspective look of man 310. FIG. 32 shows large floating eyeball 260, medium 2611, and small 261. In FIG. 33 is shown more complex and expensive to produce floating eyeballs 330, 322 having a mounting ring 331 and mounting plug 333 respectively. Utilizing vacuum-forming or injection-molded plastic allows for the different size eyeballs to be designed into the clamshell halves less expensively rather than using special floating eyeballs like those shown in FIG. 33.

Figure 34:
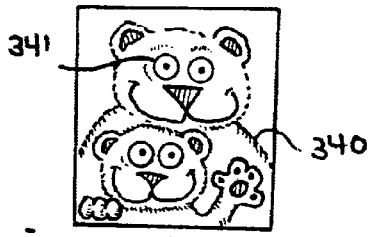
FIG. 34 is a front plan view of a four-eyeball puzzle.
Figure 36:
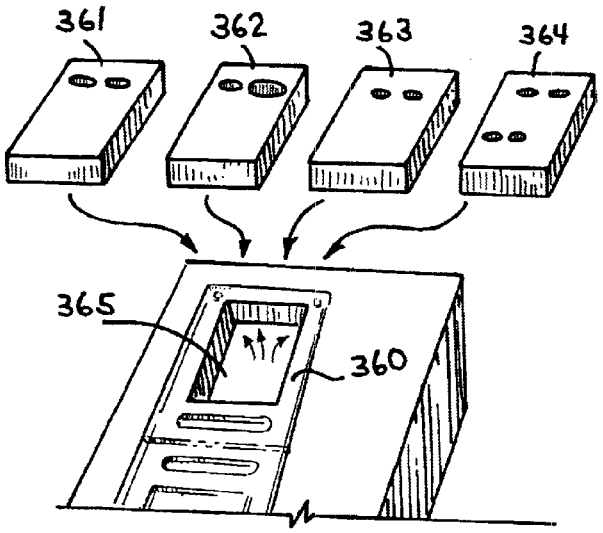
FIG. 36 is a top perspective view of a multi-baseplate embodiment for a multi-puzzle toy.
Figure 35:
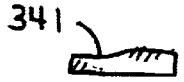
FIG. 35 is a side plan view of a 3D puzzle piece.

FIGS. 34, 35, and 36 show how multiple sets of floating eyeballs can be incorporated into a single puzzle plastic mold 360. Mold inserts 361 (two eyes, equal size), 362 (two eyes, different size), 363 (two small eyes), and 364 (two sets of small eyes) all-interchangeably fit into mold cavity 365.

FIGS. 34, 35 show how two sets of eyes can be used in animated puzzle 340. Also, a 3D eyebrow piece 341 is shown to enhance the visual effect.

Figure 37:
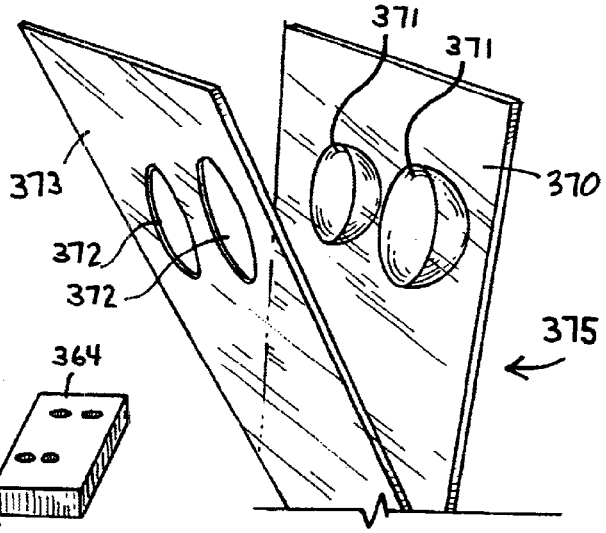
FIG. 37 is a side perspective view of a cup-style clamshell.

Referring next to FIG. 37 a clamshell puzzle 375 has halves 373, 370. Half 370 has cups 371 while half 373 only has holes 372 for the mounting of floating eyeballs (not shown). This option may be favorable when considering interchangeable mold inserts because only the cutting die would change to cut different-sized holes 372 versus interchanging the inserts found on both sides of a vacuum mold.

Referring next to FIGS. 38–44 shows a series of interactive puzzle packaging embodiments using molded clear plastic packaging. Features include:

Interactive Packaging

Consumers/puzzlers are able to wiggle and jiggle the eyeballs both on the shelf and after building the puzzle.

Great Shelf Appeal

One can clearly envision how this packaging would stand apart from all others.

Numerous Design Options

As the preceding notes demonstrate, the designs/options/versions/cosmetics are limited only to the imagination.

Product Line Extension

An entertaining, ever changing mix of product may be developed, helping to keep Eyeball Animation™ puzzles fresh on store shelves.

Options for all age Groups

All shapes, sizes and corresponding age levels may be accommodated.

One thing common to all versions of the clear plastic design is that the "packaging" is part of the product; it is as much a part of the puzzle as are the individual puzzle pieces. It is the frame that holds all of the pieces together, the showcase. The consumer must know this before "ripping" open the package, possibly being required to trim off certain heat-sealed areas, leaving behind a nice looking frame.

Figure 38:
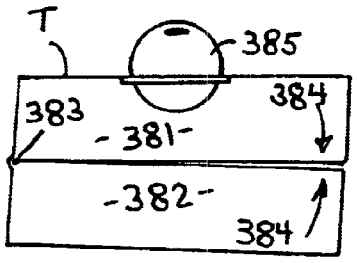
FIG. 38 is a side plan view of a folding box embodiment.

In FIG. 38 a clamshell box 380 has halves 381, 382 hinged at 383. Arrows 384 show how the box 380 is closed and can be shrink-wrapped to allow consumers to "test the product" by shaking the box before purchase. The floating eyeball 385 will dance around any graphics on box surface T.

Figure 39:
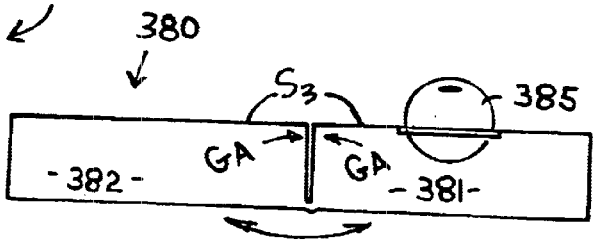
FIG. 39 is a side plan view of the FIG. 38 embodiment opened.
Figure 40:
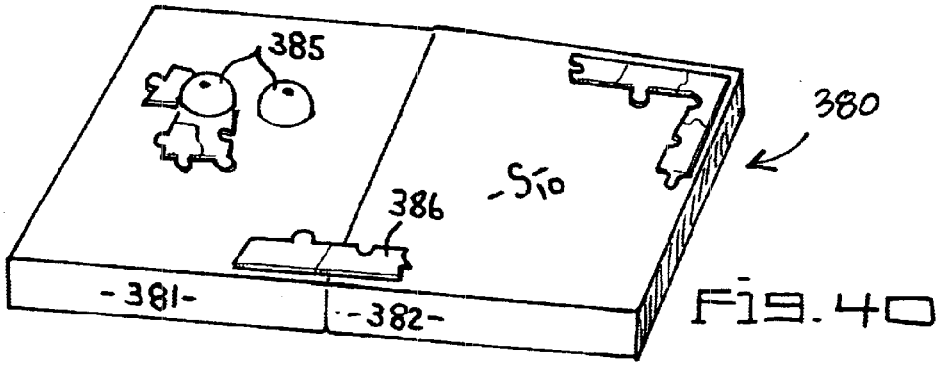
FIG. 40 is a top perspective view of the FIG. 39 embodiment partially assembled.

FIG. 39 shows the box 380 opened for use by the puzzler to build around the eyes 385. When the box 380 is opened, the gutter area GA is pinched together tightly for a smooth working surface $S_3$. FIG. 40 shows the box 380 during play with puzzle pieces 386 on smooth surface $S_{10}$.

Figure 41:
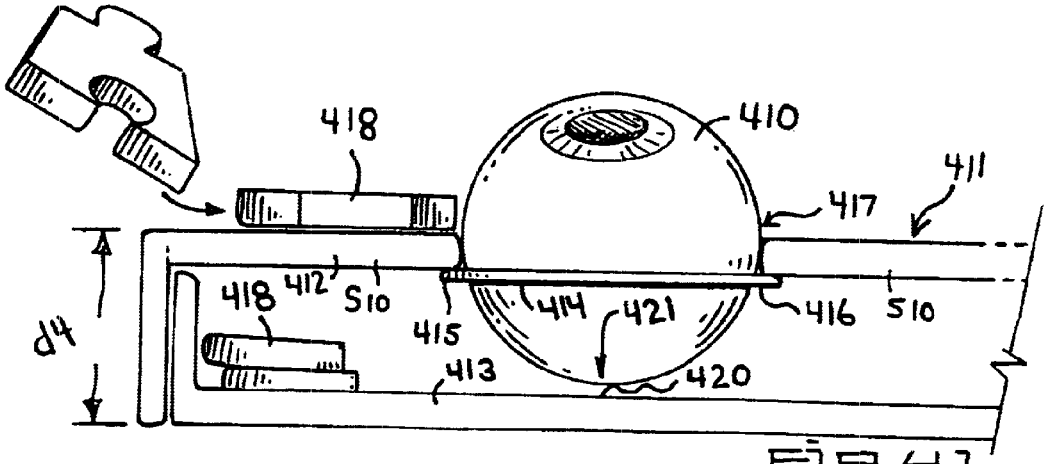
FIG. 41 is a side plan view of a locking system for a floating eyeball.
Figure 45:
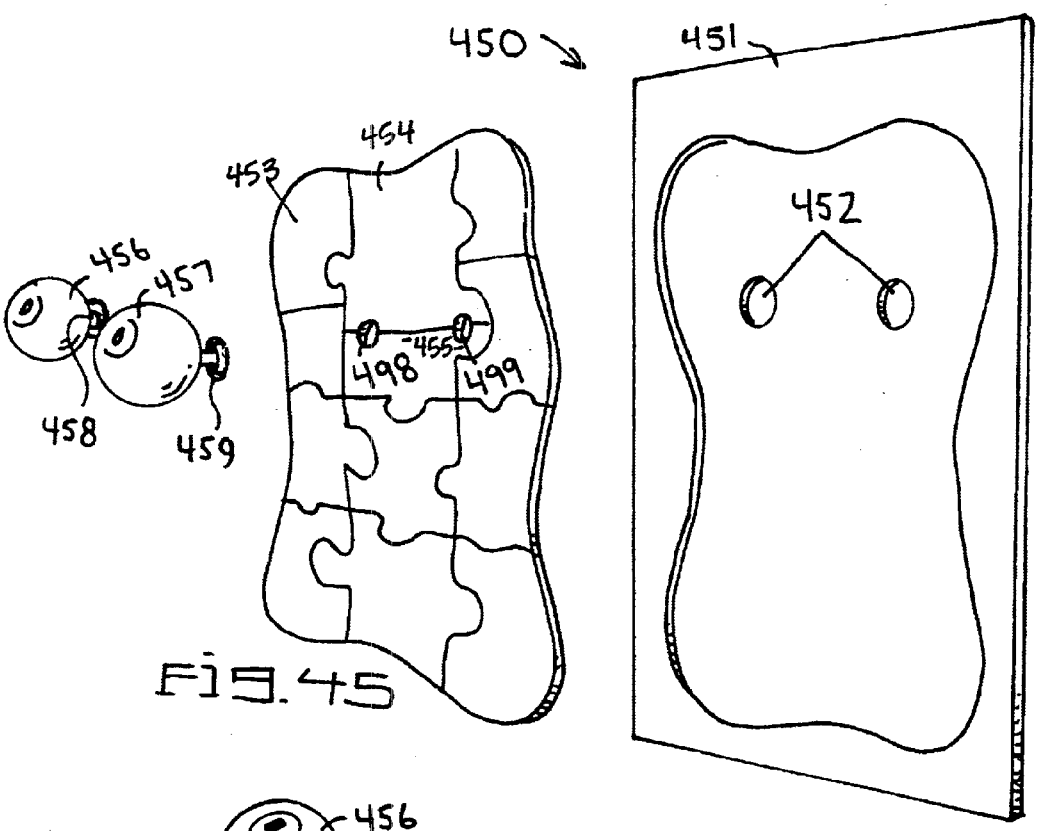
FIG. 45 is an exploded view of a large piece puzzle embodiment having the floating eyeballs attached to the puzzle pieces.
Figure 46:
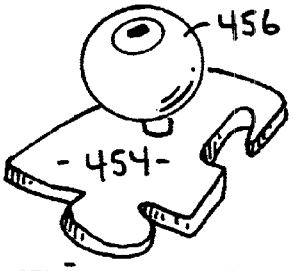
FIG. 46 is a top perspective view of a puzzle piece of FIG. 45.
Figure 47:
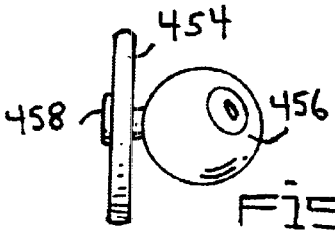
FIG. 47 is a side plan view of the puzzle piece of FIG. 46.

Referring next to FIG. 41 an apparatus to lock a floating eyeball 410 to a box 411 or equivalent structure like a board of a game is shown. The box 411 has box cover 412 and interlocking box bottom 413. Members 412, 413 are flexible. A hole 417 exists in box top 412. Width $d_4$ is a narrow three-quarters inch. A ring 414 snaps into the hole 417 with a locking overlap at 415, 416 under surface $S_{10}$. The bottom 421 of floating eyeball 410 contacts (or almost contacts) the box bottom 413 at 420. Puzzle pieces 418 are placed around the eyeball 410 or stored inside the box 411. The consumer is unable to pull the eyeball out or push the eyeball further into the box while the box 411 is closed on a retail shelf so long as the box 411 is secured closed by a known manner not shown such as taped shut.

Referring next to FIGS. 42, 43 a common everyday box 420 has floating eyeballs 421 glued or otherwise secured to box top 422. The box bottom 423 is flipped over and aligned with the box top 422 in FIG. 43 to provide a working surface $S_8$ for the puzzler using puzzle pieces 418.

Referring next to FIG. 44 box 440 is preferably the type shown in FIG. 41 having removable floating eyeballs 410. The puzzle pieces 418 are stored inside the box 440 which has a bottom portion 446. A die-cut foldout board 444 is also stored in the box 440. The board is hinged at 445. The puzzler can either finish the puzzle on the open board 444 as shown and then pick up the board 444 to place on the box top 441, or take out the eyeballs 410 and place them into the holes 443 of the board 444.

Referring next to FIGS. 45–54 a variety of large 3D puzzle pieces are shown. The large piece puzzle 450 has a backboard 451 with holes 452 to accommodate mounting plugs 458, 459 of floating eyeballs 456, 457 respectively; Puzzle pieces 453 are conventional. However, pieces 454, 455 have holes 498, 499 to accommodate mounting plugs 458, 459 respectively. The puzzle piece and eyeball become one. A simple and fashionable display is provided at low cost. Alternately, the plugs 458, 459 may be made smooth so that the holes 452 would not be necessary.

Figure 48:
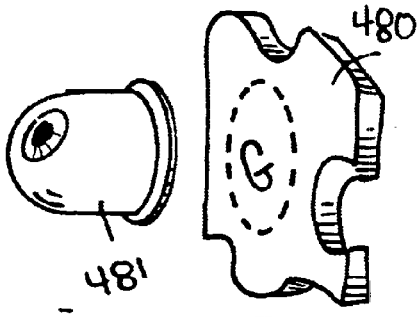
FIG. 48 is an exploded view of a glued eyeball-to-puzzle piece.
Figure 49:
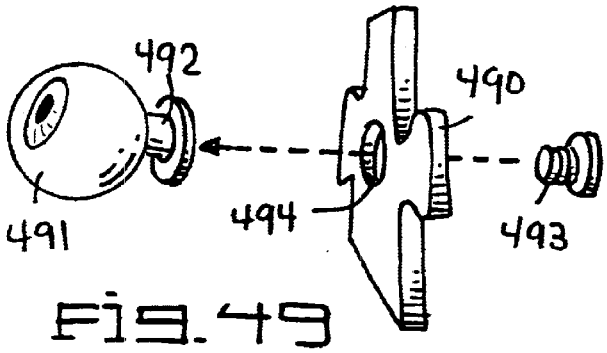
FIG. 49 is an exploded view of a screwed eyeball-to-puzzle piece.

In FIG. 48 a piece .480 has a floating eyeball (or a rubber painted eyeball) 481 glued on at G. In FIG. 49 a piece 490 has a hole 494 through which bolt 493 threads into collar 492 of eyeball 491.

Figure 50:
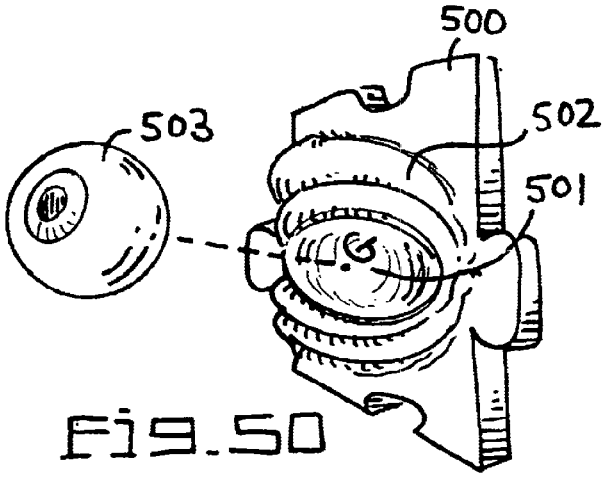
FIG. 50 is an exploded view of a 3D glued eyeball-to-puzzle piece.

FIG. 50 shows piece 500 using a traditional spherical floating eyeball 503. A cup 501 is formed, and glue G holds the eyeball 503 in place. Optional 3D features 502 may be included.

Figure 51:
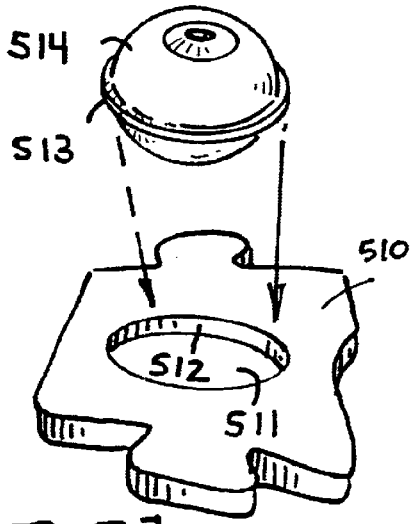
FIG. 51 is an exploded view of a pressure-fitting eyeball-to-puzzle piece.

In FIG. 51 a piece 510 has a hole 511 with a groove 512 to receive a snap ring 513 on eyeball 514.

Figure 52:
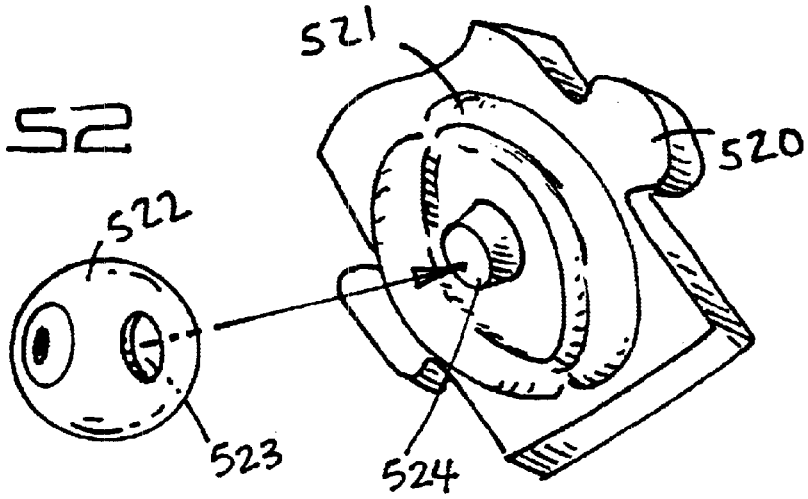
FIG. 52 is an exploded view of a 3D puzzle piece with a snap-on eyeball.

In FIG. 52 a piece 520 has a molded 3D eyelid 521. A plug 524 secures the eyeball 522 via hole 523.

Figure 53:
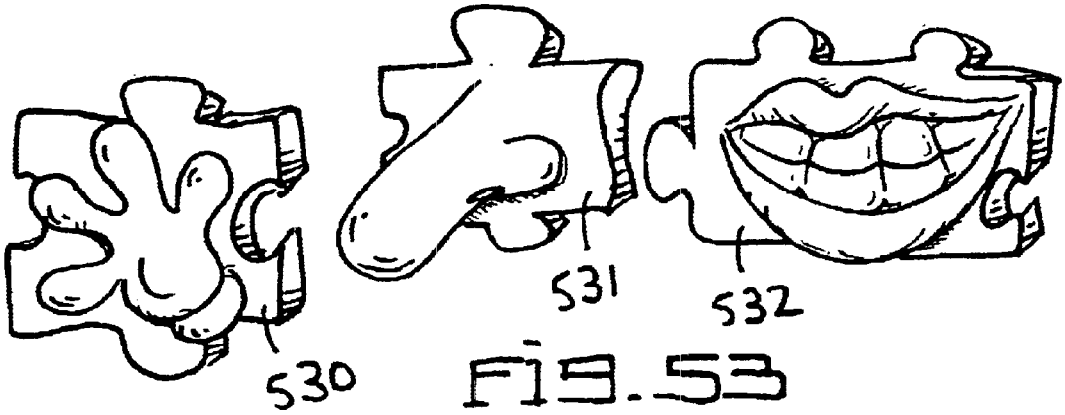
FIG. 53 is a top perspective view of 3D puzzle pieces.

In FIG. 53 other 3D features are shown in pieces 530, 531, 532. Said features are preferably molded in plastic, whereas the rest of the puzzle is made of cardboard. The pieces 530, 531, 532 coordinate with the floating (or painted) eyeball 522.

Figure 54:
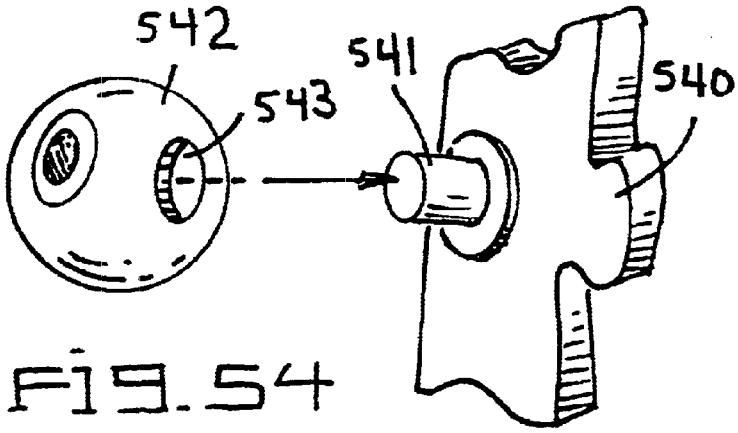
FIG. 54 is an exploded view of a plug-type puzzle piece.

In FIG. 54 a flat piece 540 has a plastic plug 541 which is received by hole 543 of eyeball 542 wherein piece 540 is made of cardboard.

FIGS. 55,56 show stackable containers 550. The base has a recess 553 to accommodate floating (or painted) eyeballs 552 which are secured to the container top 551. The container can be any shape from round to square. The eyeballs may snap in or be glued.

In FIGS. 57,58 a simple puzzle/box embodiment 570 has a traditional box bottom 576 that holds puzzle pieces 577. The puzzle pieces may have a puzzle on each side, or be just a one sided puzzle.

A box liner/puzzle board 573 has holes 574,575 in which the spherical toy balls 572 are mounted. The box top 571 has matching holes 574T, 575T from which the balls 572 protrude when the box is closed as shown in FIG. 58. The picture of the puzzle (maybe a dinosaur) can be displayed on the cover 571*c* with the balls (maybe floating eyeballs) coordinated with both the cover display and the completed puzzle on the board 573.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A clamshell jigsaw puzzle comprising:

an upper and a lower clamshell half;

an integral base capable of supporting said clamshell halves in a vertical position when said clamshell halves are in a closed mode;

a jigsaw puzzle fitted between the clamshell halves; and said jigsaw puzzle having a spherical toy ball coordinated between a group of puzzle pieces.

2. The jigsaw puzzle of claim 1, wherein the clamshell halves have a hinge joint therebetween.

3. The jigsaw puzzle of claim 2, wherein the clamshell halves have a closed mode, thereby enclosing the jigsaw puzzle.

4. The jigsaw puzzle of claim 1, wherein the jigsaw puzzle has a front side puzzle and a rear side puzzle, each side coordinated with said spherical toy ball.

5. A standing clamshell jigsaw puzzle comprising:

an integral base;

said base having a left and a right clamshell half supported therefrom;

a spherical toy ball supported between the left and the right clamshell half; and a jigsaw puzzle coordinated with the spherical toy ball supported between the left and the right clamshell half.

6. The jigsaw puzzle of claim 5, wherein the integral base has a left and a right hinge segment supporting the respective clamshell halves.

7. The jigsaw puzzle of claim 5, wherein the left and right clamshell halves have a hinge along a top edge, and the base has a built in puzzle piece storage container.

8. The jigsaw puzzle of claim 1, wherein the spherical toy ball is a floating body part.

9. The jigsaw puzzle of claim 8, wherein the spherical toy ball is a floating eyeball.

10. The jigsaw puzzle of claim 2, wherein the clamshell halves have an open mode, thereby allowing a puzzler to rearrange a plurality of puzzle pieces stored therebetween said clamshell halves.

11. The jigsaw puzzle of claim 2, wherein the base has a built in puzzle piece storage container.

12. The jigsaw puzzle of claim 5, wherein the puzzle has a front side puzzle and a rear side puzzle, each side coordinated with said spherical toy ball.

13. The jigsaw puzzle of claim 5, wherein the spherical toy ball is a floating body part.

14. The jigsaw puzzle of claim 13, wherein the spherical toy ball is a floating eyeball.

15. The jigsaw puzzle of claim 6, wherein the clamshell halves have an open mode, thereby allowing a puzzler to rearrange a plurality of puzzle pieces stored therebetween said clamshell halves.

16. The jigsaw puzzle of claim 6, wherein the clamshell halves have a closed mode, thereby enclosing the jigsaw puzzle.

17. The jigsaw puzzle of claim 7, wherein the clamshell halves have an open mode, thereby allowing a puzzler to rearrange a plurality of pieces.

18. The jigsaw puzzle of claim 7, wherein the clamshell halves have a closed mode, thereby enclosing the jigsaw puzzle.

19. A clamshell jigsaw puzzle comprising:

an upper and a lower clamshell half;

an integral base capable of supporting said clamshell halves in a vertical position when said clamshell halves are in a closed mode;

a jigsaw puzzle fitted between the clamshell halves;

said jigsaw puzzle having a spherical toy ball coordinated between a group of puzzle pieces; and wherein the clamshell halves have a hinge joint therebetween.

* * * * *